United States Patent [19]

Bayh, III

[11] Patent Number: 4,589,482

[45] Date of Patent: May 20, 1986

[54] WELL PRODUCTION SYSTEM

[75] Inventor: Russell I. Bayh, III, Carrollton, Tex.

[73] Assignee: Otis Engineering Corporation, Dallas, Tex.

[21] Appl. No.: 617,025

[22] Filed: Jun. 4, 1984

[51] Int. Cl.[4] ..... E21B 43/12; E21B 34/10

[52] U.S. Cl. ..... 166/105.5; 166/105.6; 166/117.5; 166/188; 166/321

[58] Field of Search ..... 166/117.5, 106, 105.5, 166/188, 322, 316, 332, 319, 321, 72, 198, 149, 183, 334

[56] References Cited

U.S. PATENT DOCUMENTS

| | | | |
|---|---|---|---|
| 3,897,822 | 8/1975 | Mott | 166/321 X |
| 4,354,554 | 10/1982 | Calhoun et al. | 166/321 |
| 4,461,353 | 7/1984 | Vinzant et al. | 166/322 |
| 4,502,536 | 3/1985 | Setterberg, Jr. | 166/105.5 |

*Primary Examiner*—James A. Leppink
*Assistant Examiner*—Hoang C. Dang
*Attorney, Agent, or Firm*—Vinson & Elkins

[57] ABSTRACT

A well production system in which a submersible pump is utilized in producing the well and gas produced by the well is bypassed through a packer with a special control valve which is constructed and arranged to permit ready passage of sound waves through the valve to facilitate determining the fluid depth in the well.

3 Claims, 3 Drawing Figures

WELL PRODUCTION SYSTEM

Figure 1:
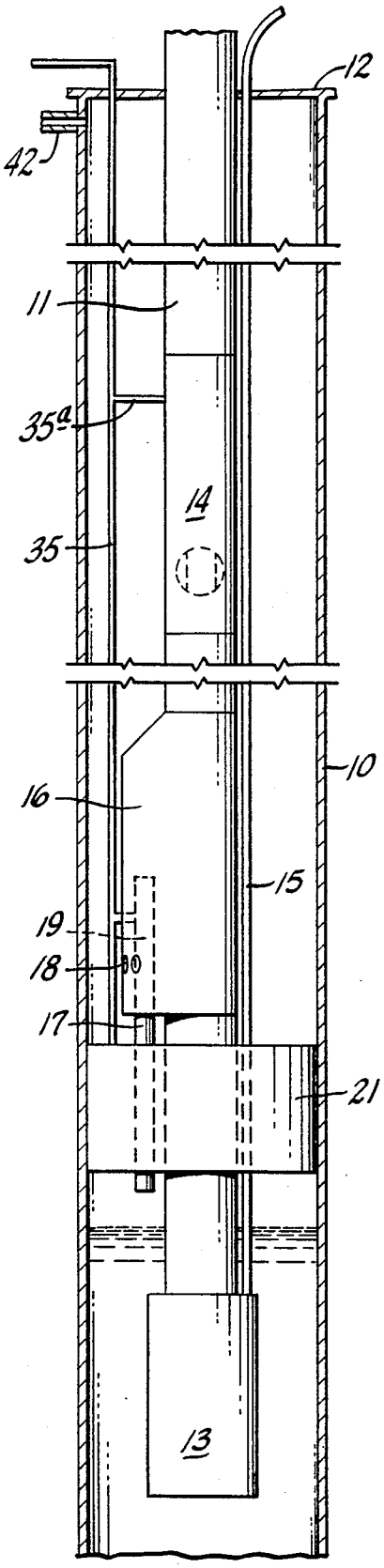

This invention relates to a well production system and, more particularly, a system for producing a well with a submersible pump.

Wells are conventionally produced with submersible pumps. The system conventionally employs a pump suspended from a tubing below a packer and a means for conducting vent gas through the packer to the surface. Both the tubing and vent gas are conventionally valve controlled so that both passageways may be shut-in from the surface.

In positioning the pump it is desirable to know the liquid level within the well. For this purpose, sound waves are projected down the well and reflected back from the liquid surface to assist the operator in positioning the pump and from time-to-time checking the level of liquid in the well, if desired.

To be sure that sound waves will reach the liquid level it has been proposed that the sound waves be permitted to pass through the valve controlling the gas passageway; see U.S. patent application Ser. No. 06/489,537 of John R. Setterberg, Jr.

Read U.S. Pat. No. 4,387,767 shows a submersible pump system utilizing control valves to control flow through the tubing and through the gas exhaust system. See also U.S. Pat. No. 4,354,554 and *Composite Catalog of Oil Field Equipment and Services,* 35th Rev., page 1579, which shows control of gas through an annulus type of valve. This type of structure is objectionable as it reduces the size of tubing through which fluid is produced, particularly in small diameter wells. See also *Composite Catalog of Oil Field Equipment and Services,* 33rd Rev., page 1197, which shows a system employing a chamber lift.

It is an object of this invention to provide a production system utilizing a submersible pump in which a special design for the valve controlling the gas vent passage is provided which permits ready passage of sound waves through the valve to determine the liquid level in the well.

Another object is to provide a production system, as in the preceding object, in which the gas control valve is carried in a side pocket mandrel in the tubing and the wall of the side pocket and the valve therein are ported in an upwardly and outward direction to provide for minimum change in path of sound waves as they pass through the control valve.

Another object is to provide a system, as in the preceding object, in which a flapper valve is employed and the flapper valve, when open, provides adequate, unobstructed path for passage of sound waves through the valve.

Other objects, features and advantages of this invention will be apparent from the drawings, the specification and the claims.

Figure 2A:
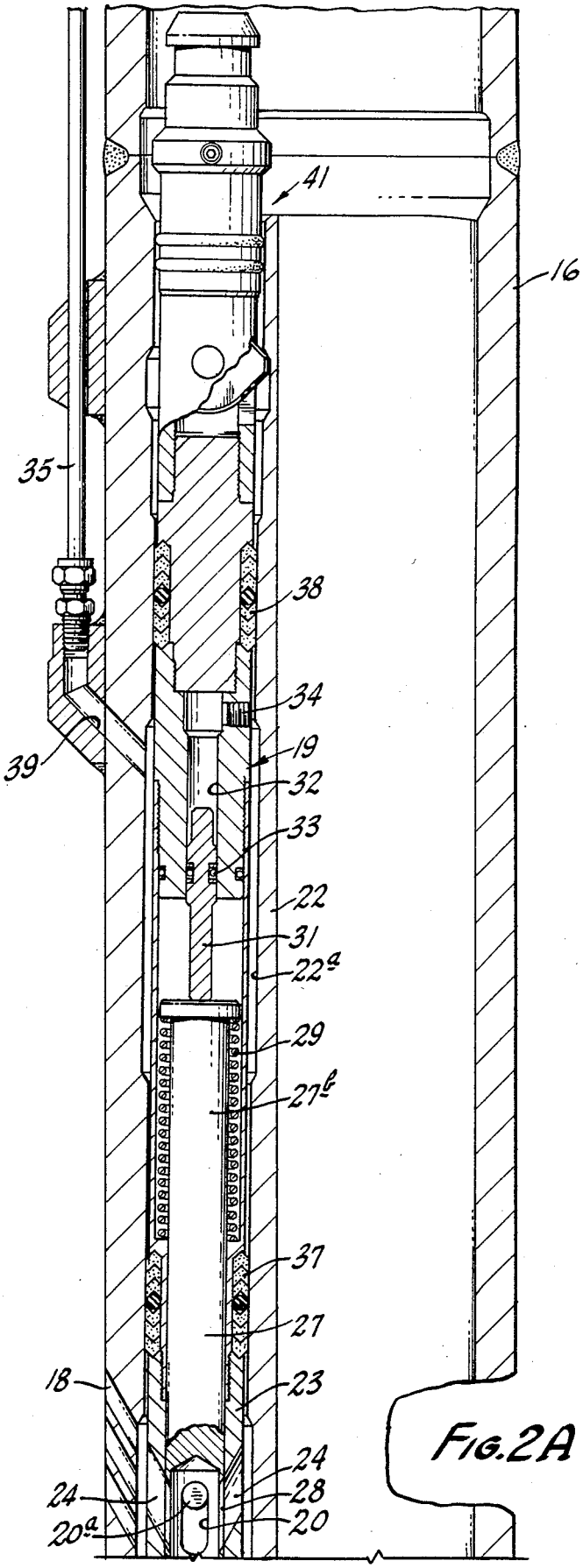
Figure 2B:
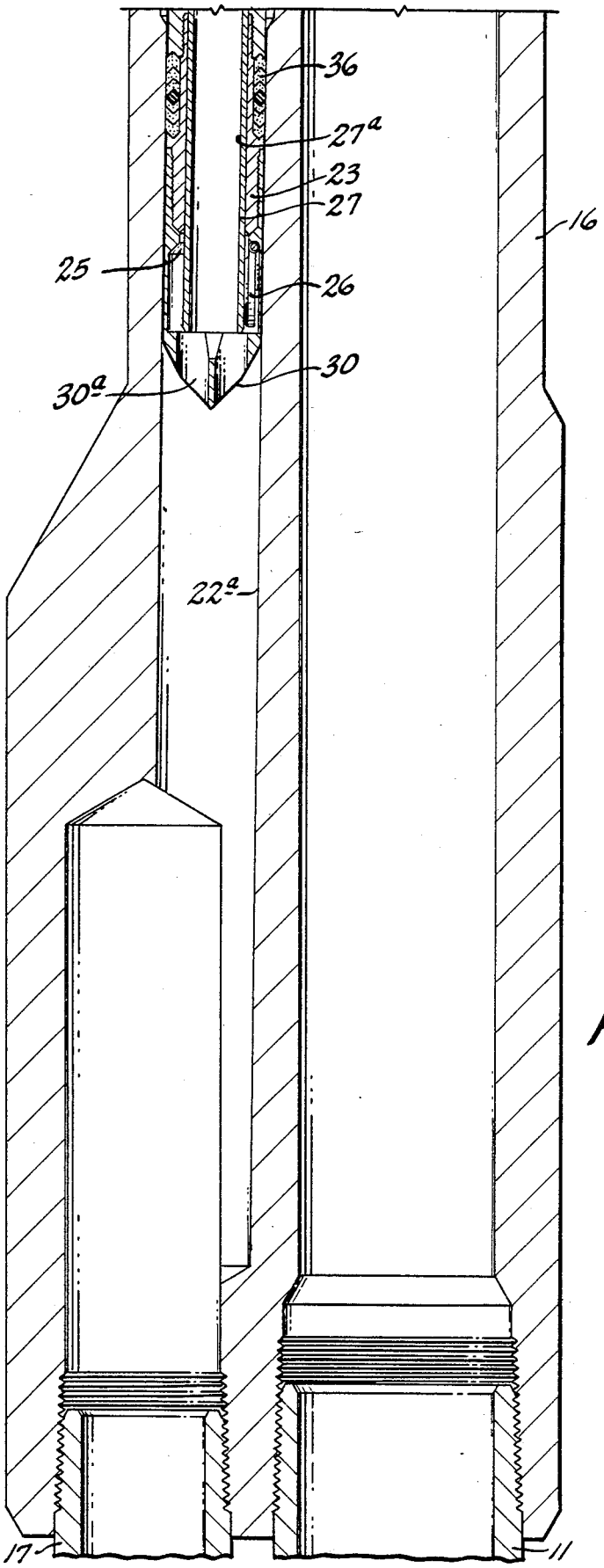

In the drawings wherein an illustrative embodiment of this invention is shown and wherein like parts are indicated by like reference numerals:

FIG. 1 is a schematic illustration of a well system in accordance with this invention; and FIGS. 2A and 2B are continuing sectional views through a portion of a side pocket mandrel, showing in section a preferred form of control valve.

Referring first to FIG. 1, a well is shown having a conventional casing 10 in which there is suspended a tubing 11 from the wellhead, indicated generally at 12.

Secured to the bottom of the tubing string 11 is a pump 13 of the submersible fluid type which produces through the tubing 11. Control of flow through the tubing is provided by the conventional subsurface safety valve 14.

Power for operating the pump 13 is provided by the power line 15 which may be an electrical cable.

The tubing 11 includes a side pocket mandrel which may be generally conventional in form and have means at its lower end for having secured thereto a tailpipe 17 depending from the valve pocket. The side pocket mandrel has side port means 18 therein and a control valve, indicated generally at 19, controls flow through the side port 18 and the tailpipe 17.

A packer, indicated generally at 21, seals between the casing 10 and each of the power line 15, tubing string 11, and tailpipe 17, all of which extend through the packer.

Referring now to FIGS. 2A and 2B, the side pocket mandrel 16 has a side pocket 22 for receiving therein the retrievable side pocket valve, indicated generally at 19. As indicated in FIG. 1, the lower end of the side pocket is open and has secured thereto the tailpipe 17. The bore **22*a* of the side pocket 22 extends generally longitudinally of the side pocket mandrel and is parallel to the centerline through the tubing and has a substantially straight through opening at its lower end to receive the tailpipe 17**.

The side port means is provided by a plurality of ports 18 which extend upwardly and outwardly of the side pocket mandrel. This upward and outward direction facilitates movement of sound waves through the valve pocket.

The retrievable valve means 19 in said valve pocket controls flow between the side port 18 and the tailpipe 17.

The valve 19 has a tubular body 23 with upwardly and outwardly extending flowway means 24 spaced circumferentially about the body in the side wall thereof. Preferably, at least four symmetrically arranged flowways 24 are provided to insure alignment of a flowway 24 with a port 18 through the mandrel. When the valve is landed these flowway means 24 are in communication with the port means 18 and are positioned directly adjacent the side port means to permit sound waves to move from the side port means 18 directly through the flowway means 24 into the body with minimum change in direction. These flowway means are also in communication with the lower end of the body and provide a cooperating path for gas flow and for passage of sound waves between the tubing-casing annulus and the tailpipe 17 with minimum change in direction of flow.

The valve means 19 is provided with a cooperating valve seat and valve member which preferably are the seat 25 and flapper valve member 26 adjacent the lower end of the body 23. The valve seat and valve member, when the valve is in open position, should provide sufficient unobstructed opening to permit ready passage of sound waves therethrough.

In the preferred form of valve, the flapper valve member 26 is controlled by reciprocation of the valve operator 27. The valve operator 27 in its lower portion is a hollow tubular member having a plurality of passageway means 28 which extend upwardly and outwardly and are in alignment with the flowway means 24 and the side port means 18 when the actuator 27 is in its down position to maintain the valve open. The slot 20 in the operator cooperates with the pin 20*a* carried by the valve body to maintain this alignment. Thus, with the valve open as shown in the drawing, acoustical waves pass in a generally straight line through the cooperating upwardly and outwardly extending side ports 18, flowway means 24 and passageway means 28. Such waves pass through the bore 27*a*, through the lower end of the actuator, and through the lower end of the valve. The valve below the flapper 26 is provided with the conventionally shaped nose 30 to assist in passage through the well and landing in the pocket. The nose 30 is provided with a plurality of vertically extending holes 30 and acoustical waves freely pass through these vertical holes 30*a*.

At its upper end the actuator 27 may be solid, as shown at 27*b* and resilient means, such as the spring 29, urges the actuator in an upward or closing direction. The flapper valve member 26 will also be provided with a small spring, not shown, for urging it toward closed position so that the flapper will close when the actuator 27 moves upwardly.

Above and in contact with the upper end of the actuator 27 is a small diameter piston 31 which has a sliding relationship with the cylinder 32. Suitable seal means 33 carried by the piston seals with the cylinder 32. Control fluid is introduced into the cylinder 32 through the port 34 which receives control fluid from the control conduit 35.

The valve 19 is provided with three seal means 36, 37 and 38. The seals 36 and 37 straddle the side port means 18 and the seals 37 and 38 straddle the port 39 which is connected to the control conduit 35.

At its upper end the valve is provided with a conventional lock 41 to lock it in the side pocket.

Referring again to FIG. 1, the control line 35 has a branch line 35*a* which connects with and controls the subsurface safety valve 14. Also, the control line may extend to and be utilized in setting of the packer 21, as indicated in FIG. 1.

In use the system will be assembled and run into and suspended in the well. Prior to setting the packer the subsurface safety valve control line 39 will preferably be pressurized to open valve 19. At this time sound waves may be generated and they will pass through the control valve 19, utilizing the inclined pathways through the side pocket, the valve body and the valve actuator, and the straight through passage in the bottom of the valve member to provide a path with minimum change in direction for these waves to pass through the tailpipe 17, strike the surface of liquid within the well, and return to the surface as an indication of the depth of liquid within the well. After the packer 21 has been set at the desired level, the operator may then, or at any subsequent time, check the fluid level by maintaining the valve 19 in open position while sending sound waves down through the casing-tubing annulus.

During flooring of the well, the control line 35 will be pressurized to maintain the two valves 14 and 19 open and the pump 13 will lift fluid from the well and deliver it to the surface through the tubing 11. Gas in the casing-tubing annulus below the packer 21 will rise through the tailpipe 17, the valve 19, and the casing-tubing annulus above the packer to the surface and be removed through the pipe 42. If at any time it is desired to shut-in the well, the pressure within the control line 35 is reduced to permit the spring 29 to close valve 19 and to permit the subsurface safety valve 14 to close, normally in response to a resilient means such as a spring.

From the above it will be seen that there has been provided a well production system utilizing a submersible pump with the customary gas vent system in which the gas vent has been constructed to permit passage of sound waves through the side pocket and controlling valve therein with minimum change of direction to obtain accurate reflective indication of the level of liquid within the well.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A well production system comprising:

a casing;

a tubing within the casing;

a subsurface safety valve controlling flow through the tubing;

a submersible pump in the lower end of the tubing for delivering liquid through said tubing;

a line extending downwardly in the casing-tubing annulus delivering power from the surface to the pump;

a side pocket mandrel in the tubing having a valve pocket;

side port means in said valve pocket angled upwardly and outwardly;

a tailpipe extending downwardly from said side pocket alongside and substantially parallel throughout its length with the axis of said tubing;

a packer carried on the tubing between the side pocket mandrel and pump;

said packer sealing between the casing and each of said power line, tubing and tailpipe;

retrievable valve means in said valve pocket controlling flow between said side port and said tailpipe;

said valve means having a tubular body with upwardly and outwardly extending flowway means in the side wall thereof and in communication with said port means and the lower end of said body to provide a cooperating path for gas flow and for passage of sound waves;

said valve means provided with a valve seat and valve member below said flowway means providing when open sufficient unobstructed opening to permit ready passage of sound waves therethrough; and means for opening and closing said subsurface safety valve and retrievable valve means.

2. The system of claim 1 wherein said valve member is a flapper.

3. The system of claim 1 wherein said valve member is a flapper and a tubular actuator is slidable in said body to control opening and closing of said flapper;

said actuator having upwardly and outwardly extending passageway means cooperable with the bore through said actuator and said flowway means to provide a path for gas and sound waves when said flapper is open and means maintaining said passageway means aligned with said flowway means.

* * * * *